US012669271B2

(12) United States Patent
Shanmugam et al.

(10) Patent No.: US 12,669,271 B2
(45) Date of Patent: Jun. 30, 2026

(54) HEAT RECLAIM SYSTEM

(71) Applicant: Hill Phoenix, Inc., Conyers, GA (US)

(72) Inventors: Senthilkumar Kandappa Goundar Shanmugam, Covington, GA (US); Jeffrey Newel, Snellville, GA (US); Scott Martin, Conyers, GA (US); Matthew W. Walden, Covington, GA (US); Joseph Richardson, Conyers, GA (US)

(73) Assignee: Hill Phoenix, Inc., Conyers, GA (US)

( * ) Notice: Subject to any disclaimer, the term of this patent is extended or adjusted under 35 U.S.C. 154(b) by 0 days.

(21) Appl. No.: 19/119,382

(22) PCT Filed: Jan. 3, 2025

(86) PCT No.: PCT/US2025/010336

§ 371 (c)(1),
(2) Date: Apr. 8, 2025

(87) PCT Pub. No.: WO2025/147683

PCT Pub. Date: Jul. 10, 2025

(65) Prior Publication Data

US 2026/0009563 A1 Jan. 8, 2026

Related U.S. Application Data

(60) Provisional application No. 63/617,305, filed on Jan. 3, 2024.

(51) Int. Cl.

| | |
|---|---|
| ***F25B 41/20*** | (2021.01) |
| ***F25B 9/00*** | (2006.01) |
| ***F25B 49/02*** | (2006.01) |

(52) U.S. Cl.

CPC ..... *F25B 9/008* (2013.01); *F25B 41/20* (2021.01); *F25B 49/02* (2013.01); *F25B 2400/23* (2013.01)

(58) Field of Classification Search

CPC ..... F25B 41/20; F25B 49/02; F25B 2400/23; F25B 2500/18; F25B 2600/25;

(Continued)

(56) References Cited

U.S. PATENT DOCUMENTS 4,409,796 A * 10/1983 Fisher ..... F24D 11/0214 62/238.7

10,502,461 B2 12/2019 Christensen et al.

(Continued)

OTHER PUBLICATIONS

International Search Report and Written Opinion in related International Application No. PCT/US2025/010336, dated Apr. 4, 2025, 13 pages.

*Primary Examiner* — Jonathan Bradford
(74) *Attorney, Agent, or Firm* — Fish & Richardson P.C.

(57) ABSTRACT

A refrigeration system includes one or more compressors (14,24), a gas cooler (105), a flash tank (106), one or more evaporators (12,22), a heat reclaim system (110), valves (120,122,124,126), and a control system (105). The heat reclaim system receives a working fluid from the one or more compressors and the gas cooler. The heat reclaim system is fluidly coupled, through a first supply line (111), to the one or mor compressors, and fluidly coupled, through a second supply line (113), to the gas cooler. The valves regulate a flow of the working fluid from the one or more compressors and the gas cooler to the heat reclaim system. The control system receiving at least one feedback signal from the heat reclaim system and, in response to the at least one feedback signal, operates the valves to regulate an amount of the working fluid circulated into the heat reclaim system from the one or more compressors and the gas cooler.

20 Claims, 7 Drawing Sheets

(58) Field of Classification Search
CPC ..... F25B 2600/2507; F25B 2600/2515; F25B 2600/2523
See application file for complete search history.

(56) References Cited

U.S. PATENT DOCUMENTS

| | | | | |
|---|---|---|---|---|
| 2013/0180266 | A1* | 7/2013 | Bois | F25B 13/00 62/324.6 |
| 2019/0011148 | A1* | 1/2019 | Matsuda | F25B 13/00 |
| 2022/0357084 | A1 | 11/2022 | Elliott | |

* cited by examiner

HEAT RECLAIM SYSTEM

CROSS REFERENCE TO RELATED APPLICATIONS

This application is a U.S. National Stage Application under 35 U.S.C. § 371 and claims the benefit of International Application No. PCT/US2025/010336 filed Jan. 3, 2025, which claims the benefit of priority to U.S. Provisional Patent Application No. 63/617,305 filed Jan. 3, 2024. The entire contents of all prior applications are incorporated by reference herein.

TECHNICAL FIELD

This disclosure relates to refrigeration systems.

BACKGROUND

Refrigeration systems are used to cool spaces such as refrigerators, freezers, coolers, and display cases. Refrigeration systems rely on refrigeration cycles of a refrigerant that alternately absorbs and rejects heat as the refrigerant is circulated through the system. Refrigerants in refrigeration systems generate heat that can be recovered and routed to other systems or components such as air handlers or water boilers.

SUMMARY

Implementations of the present disclosure include a refrigeration system that includes one or more compressors, a gas cooler, a flash tank, one or more evaporators, a heat reclaim system, a plurality of valves, and a control system. The gas cooler is fluidly coupled, through a discharge line, to the one or more compressors. The flash tank is fluidly coupled, through a gas cooler line, to the gas cooler. The one or more evaporators are fluidly coupled to the flash tank and the one or more compressors. The heat reclaim system is configured to receive a working fluid from the one or more compressors and the gas cooler. The heat reclaim system is fluidly coupled, through a first supply line, to the one or more compressors, and fluidly coupled, through a second supply line, to the gas cooler. The plurality of valves are configured to regulate a flow of the working fluid from the one or more compressors and the gas cooler to the heat reclaim system. The control system is configured to perform operations including receiving at least one feedback signal from the heat reclaim system, and, in response to the at least one feedback signal, operating the plurality of valves to regulate an amount of the working fluid circulated into the heat reclaim system from the one or more compressors and the gas cooler.

In some implementations, the plurality of valves include (i) a first valve attached to the first supply line fluidly connecting the discharge line to the heat reclaim system, (ii) a second valve attached to a first return line fluidly connecting the heat reclaim system to the discharge line, (iii) a third valve attached to the second supply line, and (iv) a fourth valve attached to a second return line fluidly connecting the heat reclaim system to the gas cooler line. The control system is configured to switch the plurality of valves between a standard mode, in which the first, second, third, and fourth valves are closed, a low heat load mode, in which the first and second valves are closed and the third and fourth valves are open, and a high heat load mode, in which the first and second valves are open and the third and fourth valves are closed.

In some implementations, the heat reclaim system includes an air handling unit. The low heat load mode includes sub-cooling mode in which the working fluid heats air at a first temperature in the air handling unit, and the high heat load mode includes a de-superheating heating mode in which the working fluid heats in the air at a second temperature in the air handling unit. The second temperature is lower than the first temperature.

In some implementations, the heat reclaim system includes a heat reclaim unit and a heat reclaim controller that transmits, as a function of a parameter of the heat reclaim unit, the at least one feedback signal to the control system.

In some implementations, the feedback signal is associated with a heat load required by the heat reclaim system. In some implementations, the control system is configured to receive sensor feedback from a temperature sensor coupled to the gas cooler line and, in response to the sensor feedback, operating the plurality of valves to maintain a temperature of the working fluid entering the flash tank above a temperature threshold.

In some implementations, the refrigeration system includes a fifth valve including a 3-way mixing valve connected to and joining the discharge line to the first return line. The fifth valve is configured to regulate a flow of working fluid from the one or more compressors and the heat reclaim system into the gas cooler, and the control system is configured to set the fifth valve in one of (i) the standard mode, in which a first inlet of the fifth valve connected to the first return line is closed and a second inlet of the fifth valve connected to the discharge line is open, (ii) the low heat load mode, in which the fifth valve is in the same position as in the standard mode, or (iii) the high heat load mode, in which the fifth valve maintains a predetermined pressure differential across the fifth valve.

In some implementations, the refrigeration system includes a sixth valve including a 3-way mixing valve connected to and joining the gas cooler line to the second return line. The sixth valve is configured to regulate a flow of working fluid from the heat reclaim system and the gas cooler to the flash tank, and the control system is configured to set the sixth valve in one of (i) the standard mode, in which the sixth valve is open, (ii) the low heat load mode, in which the sixth valve maintains a predetermined pressure differential across the sixth valve, (iii) and the high heat load mode, in which the sixth valve is open.

In some implementations, the refrigeration system includes a first pump out valve and a second pump out valve, the first pump out valve attached to a first pump out line fluidly connecting the second return line to the gas cooler line downstream of the sixth valve, and second pump out valve is attached to a second pump out line fluidly connecting the first return line to the first pump out line, and the control system is configured to one of (i) open, during the standard mode, the first and second pump out valves, (ii) during the low heat load mode, close the first pump out valve and open the second pump out valve, or (iii) during the high heat load mode, open the first pump out valve and close the second pump out valve.

In some implementations, the working fluid includes carbon dioxide refrigerant.

In some implementations, the heat reclaim system includes a water heater and the parameter includes a temperature of supply water within the water heater.

In some implementations, the refrigeration system includes a second heat reclaim system fluidly coupled, through a set of supply and return lines, to the discharge line of the one or more compressors, the heat reclaim system including an air handler and the second heat reclaim system including a water heater, the control system configured to control, as a function of the at least one feedback signal, the plurality of valves, regulating an amount of the working fluid flowed into the water heater from the one or more compressors.

Implementations of the present disclosure also include a system, including a controller and a computer storage medium communicatively coupled to the controller. The computer storage medium includes instructions that, when executed by the controller, cause the controller to perform operations including receiving, from a heat reclaim system of a refrigeration system, at least one feedback signal. The refrigeration system includes one or more compressors, a gas cooler, and the heat reclaim system fluidly coupled to and configured to receive working fluid from the one or more compressors and the gas cooler. The operations also include changing, as a function of the at least one feedback signal, an operation parameter of one or more valves of the refrigeration system, regulating an amount of the working fluid flowed into the heat reclaim system from the one or more compressors and the gas cooler.

In some implementations, the refrigeration includes a flash tank. The flash tank is fluidly coupled to the gas cooler through a gas cooler line. The one or more valves include (i) a first valve attached to a first supply line fluidly connecting a discharge line to the heat reclaim system, (ii) a second valve attached to a first return line fluidly connecting the heat reclaim system to the discharge line, (iii) a third valve attached to a second supply line, and (iv) a fourth valve attached to a second return line fluidly connecting the heat reclaim system to the gas cooler line, and the changing includes switching the one or more valves between a standard mode, in which the first, second, third, and fourth valves are closed, a low heat load mode, in which the first and second valves are closed and the third and fourth valves are open, and a high heat load mode, in which the first and second valves are open and the third and fourth valves are closed.

In some implementations, the heat reclaim system includes an air handling unit, the refrigeration system including a water heater fluidly coupled to the one or more compressors, and the changing includes selectively closing at least one of the one or more valves to at least one of (i) supply working fluid into the water heater from the one or more compressors, (ii) supply working fluid into the air handling unit from the one or more compressors while preventing working fluid from flowing into the air handling unit from the gas cooler, or (iii) supply working fluid into the air handling unit from the gas cooler while preventing working fluid from flowing into the air handling unit from one or more compressors.

Implementations of the present disclosure also include a method, including receiving, from a heat reclaim system of a refrigeration system and by a controller, at least one feedback signal. The refrigeration system includes one or more compressors, a gas cooler, and the heat reclaim system fluidly coupled to and configured to receive working fluid from the one or more compressors and the gas cooler. The method also includes transmitting, by the controller and as a function of at least one feedback signal, an operating command to one or more valves of the refrigeration system to change an operation parameter of one or more valves of the refrigeration system, regulating an amount of the working fluid flowed into the heat reclaim system from the one or more compressors and from the gas cooler.

In some implementations, the refrigeration system includes a flash tank fluidly coupled to the gas cooler through a gas cooler line, the gas cooler fluidly coupled to the one or more compressors through a discharge line, the one or more valves include (i) a first valve attached to a first supply line fluidly connecting the discharge line to the heat reclaim system, (ii) a second valve attached to a first return line fluidly connecting the heat reclaim system to the discharge line, (iii) a third valve attached to a second supply line fluidly connecting the gas cooler line to the heat reclaim system, and (iv) a fourth valve attached to a second return line fluidly connecting the heat reclaim system to the gas cooler line, and the controller is configured to switch, as a function of the operating command, the one or more valves between a standard mode, in which the first, second, third, and fourth valves are closed, a low heat load mode, in which the first and second valves are closed and the third and fourth valves are open, and a high heat load mode, in which the first and second valves are open and the third and fourth valves are closed.

In some implementations, the heat reclaim system includes a heat reclaim unit and a heat reclaim controller that determines the at least one feedback signal as a function of a parameter of the heat reclaim unit, and receiving the at least one feedback signal includes receiving the at least one feedback signal from the heat reclaim controller.

In some implementations, the at least one feedback signal is associated with a heat load required by the heat reclaim system.

In some implementations, the method also includes receiving, by the controller and from a sensor coupled to the gas cooler line, sensor feedback, and in response to the sensor feedback, transmitting a second operation command to one or more valves to maintain a temperature of the working fluid entering the flash tank above a temperature threshold.

In some implementations, the refrigeration system includes a fifth valve including a 3-way mixing valve connected to and joining the discharge line to the first return line, the fifth valve configured to regulate a flow of working fluid from the one or more compressors and the heat reclaim system to the gas cooler, and the transmitting includes transmitting, by the processing device and to the controller, the operating command to cause the controller to set the fifth valve in one of (i) the standard mode, in which a first inlet of the fifth valve connected to the first return line is closed and a second inlet of the fifth valve connected to the discharge line is open, (ii) the subcooling mode, in which the fifth valve is in the same position as in the standard mode, or (iii) the space heating mode, in which the fifth valve maintains a predetermined pressure differential across the fifth valve.

Particular implementations of the subject matter described in this specification can be implemented so as to realize one or more of the following advantages. For example, the refrigeration system of the present disclosure increases overall efficiency by decreasing the amount of energy consumed by an air conditioning system or water heater that recovers heat from the refrigeration system. Moreover, the dedicated lines connecting the heat reclaim unit to the compressors and to the gas cooler allows the heat reclaim process to be performed without complex control valve assemblies or complex controller systems.

DETAILED DESCRIPTION

Reclaiming heat from a refrigeration system to heat a space or water can increase overall efficiency of a system and lower energy costs. The refrigeration system of the present disclosure helps optimize control strategies for heat reclaim, which can increase the system efficiency and coefficient of performance. The refrigeration system of the present disclosure utilizes heat recovery for direct air heating, direct portable water heating, indirect air heating, indirect water heating, or any combination of these.

Figure 1:
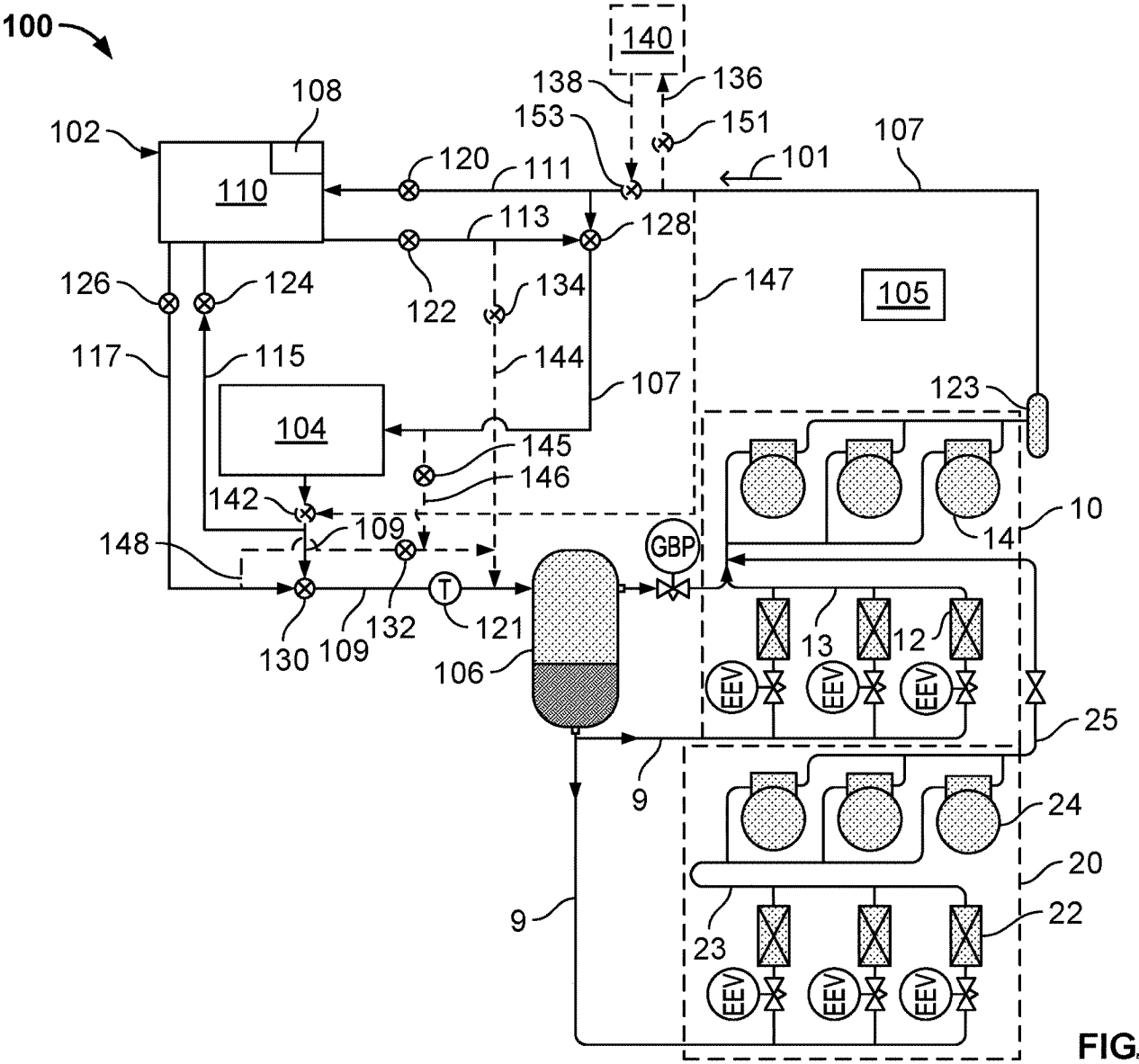
FIG. 1 is a schematic diagram of a refrigeration system according to implementations of the present disclosure.

FIG. 1 shows a schematic diagram of an example refrigeration system 100. The refrigeration system 100 can be, for example, a commercial CO2 refrigeration system, an ammonia refrigeration system, or a chilled water refrigeration system. As shown, the refrigeration system 100 is a booster system with two sets of compressors 14, 24. However, the refrigeration system 100 can also be a single pressure system with only one set of compressors 14 (e.g., only medium temperature compressors).

The refrigeration system 100 includes a medium temperature refrigeration assembly 10 and a low temperature refrigeration assembly 20. The medium temperature refrigeration assembly 10 includes one or more medium temperature compressors 14 (e.g., a set of transcritical compressors) and one or more medium temperature evaporators 12. The low temperature refrigeration assembly 20 includes one or more low temperature compressors 24 (e.g., a set of subcritical compressors) and one or more low temperature evaporators 22. The medium temperature evaporators 12 can include, for example, refrigerated display cases that display medium-temperature merchandise such as non-frozen products. The low temperature evaporators 22 can include, for example, refrigerated display cases that display low-temperature merchandise such as frozen products.

The medium temperature evaporators 12 are fluidly coupled to the compressors 14 through a first fluid line 13. The low temperature evaporators 22 are fluidly coupled to the compressors 24 through a second fluid line 23. The low temperature evaporators 22 are fluidly connected to the medium temperature evaporators 12 through a third fluid line 25. The evaporators 12, 22 are fluidly coupled to a receiver tank 106 through a fourth fluid line 9.

The refrigeration system 100 also includes a high side heat exchanger 104 (also referred to as gas cooler 104 or condenser 104), a receiver tank 106 (e.g., a flash tank or refrigerant liquid vapor separator), an oil separator 123, a heat reclaim system 102, and a control system 105. The gas cooler 104 is fluidly coupled to the medium temperature compressors 14 through a discharge line 107. The flash tank 106 is fluidly coupled to the gas cooler 104 through a gas cooler outlet line 109. In some aspects, the refrigeration system 100 can have a split gas cooler configuration instead of a single gas cooler configuration.

The heat reclaim system 102 includes, for example, a heat reclaim unit 110 and, optionally, a heat reclaim controller 108. The heat reclaim controller 110 is separate from or part of the control system 105. The heat reclaim system 102 sends feedback signals to the controller 105 to request heat from the refrigeration system. Such feedback signals can be determined, for example, based on a heat requirement of the heat reclaim unit 110, a voltage of the heat reclaim unit 110, a temperature of the heat reclaim unit 110, etc.

The heat reclaim system 102 receives working fluid 101 (e.g., carbon dioxide refrigerant) from either the medium temperature compressors 14, the gas cooler 104, or both. The heat reclaim unit 110 is fluidly coupled to and receives working fluid 101 from the medium temperature compressors 14 through a first supply line 111. The heat reclaim unit 110 is also fluidly coupled to and receives working fluid 101 from the gas cooler 104 through a second supply line 115. Also, the heat reclaim unit 110 discharges working fluid 101 to the gas cooler 104 through a first return line 113 fluidly coupled to the compressor discharge line 107. The heat reclaim unit 110 also discharges working fluid 101 to the receiver tank 106 through a second return line 117 that is fluidly connected to the gas cooler outlet line 109.

In some aspects, the first return line 113 is fluidly coupled to the gas cooler outlet line 109 through a pump out line 144 (e.g., a bleed line, shown in dashed lines as optional). Also, the second return line 117 is fluidly coupled to the pump out line 144 through an additional pump out line 148. Moreover, the first discharge line 107 is fluidly coupled to the pump out line 148 through a third pump out line 146 that has a valve 145 so that it can pump out a split gas cooler. In some aspects, valve 142 is used to divert the gas/liquid from the gas cooler 104 to heat reclaim before it goes to the flash tank 106. This diverted gas from the gas cooler 104 to the heat reclaim unit 110 further rejects heat in the heat reclaim and returns to the flash tank 106 as subcooled liquid/gas.

In some aspects, the pump out lines 144, 146, 148 are used to manage the working fluid in the system and prevent migration of the working fluid 101 to the coldest location in the system when the heat reclaim unit is exposed to temperatures lower than the saturated suction temperature of the system. In some aspects, the pump out lines and their respective valves help manage the refrigerant in the system even when the temperature in the location is not colder than the working fluid. The pump out lines allow the refrigerant to be pumped out so it can be stored and used elsewhere in the system, and can help prevent high pressure spikes when that section of the system is re-enabled and flow starts once again, thus avoiding a mass of stagnant liquid sitting and causing a pressure spike to get the liquid flowing.

In some aspects, the refrigeration system 100 includes a second heat reclaim system 140 (e.g., a heat reclaim system including a water heater). Similar to the first heat reclaim system, the second heat reclaim system 140 can include a heat reclaim unit and a heat reclaim controller (or share the same controller 108 as the first heat reclaim system 102).

The second heat reclaim system 140 is fluidly coupled, through inlet and outlet lines 136, 138, to the discharge line 107. Similar to the first heat reclaim system 102, the second heat reclaim system 140 sends feedback signals to the controller 105 to request heat from the refrigeration system.

In the illustrated example, the refrigeration system 100 includes multiple valves 120, 122, 124, 126, 128, 130, 132, 134, 142, 153, 151 that regulate a flow of the working fluid 101. The first valve 120 is coupled to the first supply line 111, the second valve 122 is coupled to the first return line 113, the third valve 124 is coupled to the second supply line 115, and the fourth valve 126 is coupled to the second return line 117. Also, the fifth valve 128 is a 3-way valve coupled to the discharge line 107 and the first return line 113, and the sixth valve 130 is a 3-way valve coupled to the gas cooler outlet line 109 and the second return line 117.

In example implementations, the first pump out valve 132 is coupled to the first pump out line 148 and the second pump out valve 134 is coupled to the second pump out line 144. Lastly, the inlet water heater valve 151 is coupled to a supply line 136 that connects the water heater 140 to the discharge line 107, and the outlet water heater valve 153 is coupled to a return line 138 that directs fluid from the water heater 140 to the discharge line 107.

The first and second valves 120, 122 regulate the flow of working between the heat reclaim unit 110 and the compressors 14 and gas cooler 104. The third and fourth valves 124, 126 regulated the flow of working fluid 101 between the heat reclaim unit 110 and the gas cooler 104 and receiver tank 106. The fifth valve 128 regulates a flow of working fluid 101 from the medium temperature compressors 14 and from the heat reclaim unit 110 into the gas cooler 104. The sixth valve 130 regulates a flow of working fluid 101 from the heat reclaim unit 110 and from the gas cooler 104 into the receiver tank 106. Lastly, the water heater valves 136, 138 regulate a flow of working fluid 101 between the water heater 140 and the discharge line 107.

The refrigeration system 100 also includes, in the illustrated example, a sensor 121 (e.g., a temperature or pressure sensor) that detects a parameter of the refrigerant at or near the inlet of the flash tank 106. Additionally, the system can include other sensors that sense parameters of other components of the system 100 such as the gas cooler 104 or the medium temperature compressors 14.

The control system 105 controls, as a function of feedback signals received from a heat reclaim system 110 and/or the temperature sensor 121, one or more of the valves of the system 100 to change a mode of operation of the refrigeration system 100. For example, the control system 105 controls valves to regulate the working fluid 101 flowed to and from the heat reclaim unit 110 to change an amount of fluid flowed into the first heat reclaim unit 110. In some aspects, the control system 105 also controls other components of the refrigeration system 100 such as the compressors 14, 24 to change a flow rate of the working fluid 101.

In some aspects, the control system 105 is a controller implemented as a computer system can include one or more processors and a computer-readable medium storing instructions executable by the one or more processors to perform the operations described here. In some implementations, the control system 105 is implemented as processing circuitry, firmware, software, or combinations of them.

In some aspects, the medium temperature compressors 14 flow a high-temperature gas to the gas cooler 104, which then condenses or cools the high-pressure working fluid 101 into a high-pressure condensate. The gas cooler 104 flows the high-pressure condensate to the receiver tank 106. The receiver tank 106 can evaporate the high-pressure condensate before it reaches the medium temperature compressors 14. To recover heat from the system 100, the control system 105 controls the valves of the refrigeration system 100 to recover heat from either the high-temperature gas or the high-pressure condensate. For example, when a large amount of heat is needed, the control system 105 flows part or all of the high-temperature working fluid 101 in the discharge line 107 to one or both of the first and second heat reclaim systems 102, 140. When a smaller amount of heat is needed, the control system 105 flows all or part of the high-pressure condensate in the gas cooler outlet line 109 to the first heat reclaim unit 110.

The control system 105 controls the valves of the refrigeration system 100 to switch the refrigeration system 100 between a standard mode, a low heat load mode (e.g., a subcooling mode), and a high heat load mode (e.g., a space heating mode or de-superheating more). In standard mode, the refrigeration system 100 operates traditionally without recovering heat from the system. In low heat load mode, the heat load needed by the coil of the first heat reclaim unit 110 is relatively low (e.g., during hot weather months when the heat is used to dehumidify the cooled air in the air handler unit). In high heat load mode, the heat load needed by the heat reclaim coil is relatively high (e.g., during cold weather months, when the heat is used to significantly heat low temperature air or to heat air significantly colder than in subcooling mode).

To set the refrigeration system 100 in standard mode, the control system 105 opens (or maintains open) the fifth valve 128 (e.g., opens the flow path to the gas cooler 104), the sixth valve 130 (e.g., opens the flow path to the receiver tank 106), and the first, second, and third pump out valves 134, 132, 142. Specifically, the control system 105 opens the first inlet (and the valve's outlet) of the fifth valve 128 connected to the discharge line 107 and closes the second inlet connected to the first return line 113. The control system 105 also opens both inlets and the outlet of the sixth valve 130 so that working fluid 101 flows freely from the gas cooler 104 to the receiver tank 106. The control system 105 closes (or maintains closed) the rest of the valves 120, 122, 124, 126, 151, 153.

To set the refrigeration system 100 in low heat load mode, the control system opens the third valve 124, fourth valve 126, fifth valve 128, sixth valve 130, second pump out valve 132, and third pump out valve 142. Specifically, the fifth valve 128 is in the same position as in the standard mode (with its flow path to the gas cooler 104 open and its second inlet closed). The control system 105 controls the sixth valve 130 to maintain a predetermined differential pressure across the sixth valve 130 to modulate the flow to the first heat reclaim unit 110. For example, the sixth valve 130 sets a differential pressure between the first return line 113 and the second return line 117 to, for example, between 10 and 20 psig (e.g., 15 psig). The control system closes the first valve 120, second valve 122, and first pump out valve 134.

In some aspects, the sixth valve 130 modulates the flow to the air handler for 10-20 psig pressure differential to prevent the total pressure drop through the heat reclaim from becoming too high and causing other operational issues in the system. Moreover, the 10-20 psig range is typical but there could be some unique circumstances where more (or less) pressure drop can be tolerated by the system and some unique reason to adjust outside that range.

To set the refrigeration system 100 in high heat load mode, the control system 105 opens the first valve 120, second valve 122, fifth valve 128, sixth valve 130, first pump out valve 134, and third pump out valve 142. Specifically, the control system 105 controls the fifth valve 128 so that the fifth valve 128 maintains a predetermined differential pressure across the fifth valve 128 to modulate the flow to the first heat reclaim unit 110. For example, the fifth valve 128 sets a differential pressure between the first return line 113 and the second return line 117 to, for example, between 10 and 20 psig. The control system 104 closes the third valve 124, fourth valve 126, and second pump out valve 132. Similar to the sixth valve 130, the fifth valve 128 modulates the flow to the air handler for 10-20 psig pressure differential to prevent the total pressure drop through the heat reclaim from becoming too high and causing other operational issues in the system.

To transition the refrigeration system 100 from standard mode to high heat load mode, the control system 105 opens the first valve 120 and second valve 122 simultaneously (e.g., using an end switch). The control system 105 also maintains the sixth valve 130 and first pump out valve 132 open and modulates the fifth valve 128 (e.g., modulates a differential pressure across the fifth valve 128 to modulate the flow to the first heat reclaim unit 110). In addition, the control system 105 closes the second pump out valve 134 and maintains the third and fourth valves 124, 126 closed.

To transition the refrigeration system 100 from low heat load mode to high heat load mode, the control system 105 opens the first and second valves 120, 122, modulates the fifth valve 128 (e.g., to 10-20 psig differential pressure to the heat reclaim unit 110), maintains the sixth valve 130 open to the flash tank 106, and opens the first pump out valve 132. In addition, the control system 105 closes the third and fourth valves 124, 126, e.g., simultaneously and closes the second pump out valve 130.

To transition the refrigeration system 100 from high heat load mode to low heat load mode, the control system 105 opens the third and fourth valve 124, 126, e.g., simultaneously. The control system 105 also maintains the fifth valve 128 open to the has cooler 110, modulates the sixth valve 130, and opens the second pump out valve 134. In addition, the control system 105 closes the first and second valves 120, 122 simultaneously and closes the first pump out valve 132.

To transition the refrigeration system 100 from low heat load mode to standard mode, the control system 105 opens the first pump out valve 132 and opens the sixth valve 130 to the receiver tank 106. The control system 105 also maintains the fifth valve 128 and second pump out valve 134 open. In addition, the control system 105 closes the third and fourth valves 124, 126 and maintains the first and second valves 120, 122 closed.

In some aspects, the control system 105 controls the valves as a function of the temperature of the working fluid 101 in the gas cooler outlet line 109. Such temperature is detected by a temperature sensor 121 coupled to the gas cooler outlet line 109. For example, the first heat reclaim unit 110 is an air handling unit and control system changes the mode of operation of the system 100 based on the temperature sensed by the temperature sensor 121.

In example implementations, if the temperature of the working fluid 101 in the gas cooler outlet line 109 satisfied a threshold (e.g., is equal to or less than, for example, between 20 and 70 degrees Fahrenheit., the control system 105 sets the refrigeration system 100 in standard mode. The threshold is a temperature at which the system bypasses the heat removal means, meaning that the system 100 bypasses (or partially bypasses) the heat reclaim system 102 and or the gas cooler 104 to keep the temperature of the refrigerant entering the flash tank above such threshold.

The control system 105 sets the refrigeration system 100 in low heat load mode or high heat load mode, depending on the feedback signal that the control system 105 receives from the heat reclaim system 102. For example, the control system 105 (e.g., refrigeration controller) receives an input signal from the heat reclaim controller 108 to request high temperature or lower temperature heat reclaim and, based on such input, the control system 105 will provide high or low temperature working fluid from the discharge (or gas cooler) to the heat reclaim system 110.

In some aspects, the first heat reclaim unit 110 is an air handling unit and the heat reclaim controller 108 requests heat from the controller 105 based on the heat requirements of the air handling unit.

Thus, the control system 105 controls the valves to either supply working fluid 101 to the first heat reclaim unit 110, to the second heat reclaim system 140, or to both heat reclaim systems 102, 140 based on the heat load requirements of these heat reclaim systems 102, 140. During the high heat load mode of the refrigeration system 100, the control system 105 controls the valves to supply working fluid 101 into the first heat reclaim unit 110 from the medium temperature compressors 14 while preventing working fluid 101 from flowing into the heat reclaim unit 110 from the gas cooler 104. During the low heat load mode, the control system 105 controls the valves to supply working fluid 101 into the first heat reclaim unit 110 from the gas cooler 104 while preventing working fluid 101 from flowing into the first heat reclaim unit 110.

Figure 2:
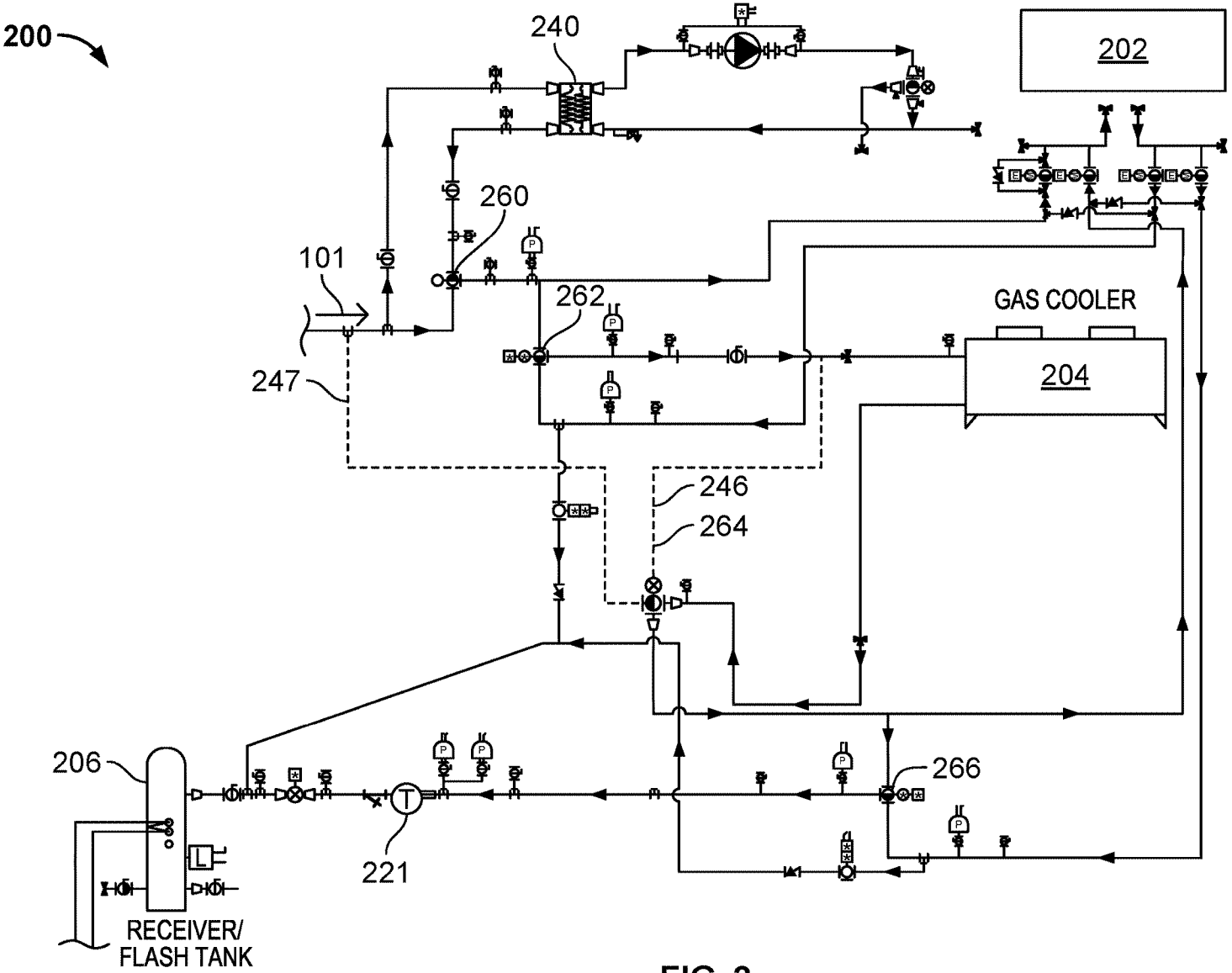
FIG. 2 is an example schematic diagram of a heat reclaim system.

FIG. 2 shows an example diagram of a heat reclaim system 200 according to implementations of the present disclosure. Similar to the refrigeration system 100 of FIG. 1, the heat reclaim system 200 includes an air heat reclaim unit (e.g., an air heat reclaim coil), a water heat reclaim unit 240 (e.g., a water heat reclaim coil), a gas cooler 204, and a receiver tank 206. The heat reclaim system 200 also include a first 3-way valve 260, a second 3-way valve 262, a third 3-way valve 264, and a fourth 3-way valve 266. In more aspects, all the 3-way valves are mixing valves.

In some aspects, the heat reclaim system 200 includes a water heater bypass line 247 or a gas cooler bypass line 246 or both. For example, the heat reclaim system 200 can be configured as a stage one system (e.g., a system for portable or hydronic water heat reclaim) with a gas cooler bypass line 246 (and without the water heater bypass line 247). The gas cooler bypass line 246 connects the inlet pipe of the gas cooler 204 to the third valve 246. Alternatively, the heat reclaim system 200 can be configured as a stage two system (e.g., a system for direct or hydronic air heat reclaim) with a water heater bypass line 247 (and without the gas cooler bypass line 246). The water heater bypass line 247 connects the discharge line to the third valve 246.

With the heat reclaim system 200 arranged as a stage one system, the control system (shown in FIG. 1) receives feedback signals from the water heat reclaim unit 240 and opens the first valve 260 to the water heat reclaim unit 240. In addition, the first valve 260 is modulated to maintain a predetermined pressure differential (e.g., 10-20 psig) across the valve 260 (this value can be adjusted based on the need). Once the controller 105 determines that the water heat reclaim unit 240 is satisfied, the first valve 260 stops the modulation.

In standard mode operation, the system 200 flows the working fluid 101 from the first valve 260 to the second valve 262, from the second valve 262 to the gas cooler 204, from the gas cooler to the third valve 264, from the third valve 264 to the fourth valve 266, and from the fourth valve 266 to the receiver tank 206.

In a mode that combines water heating with subcooling air heating, the system 200 flows the working fluid 101 from the water heat reclaim unit 240 to the first valve 260 and from the first valve 260 to the second valve 262. In some aspects, the first valve 260 can be disposed upstream of the water heat reclaim unit 240 such that the working fluid 101 flows from the first valve 262 to the water heat reclaim unit 240 and from the water heat reclaim unit 240 to the second valve 262. Then, the system 200 flows the working fluid 101 from the second valve 262 to the gas cooler 204, from the gas cooler 204 to the third valve 264, from the third valve 264 to the air heat reclaim unit 202, from the air heat reclaim unit 202 to the fourth valve 266, and from the fourth valve 266 to the receiver tank 206.

In another mode that combines water heating with de-superheating air heating, the system 200 flows the working fluid 101 from the water heat reclaim unit 240 to the first valve 260 and from the first valve 260 to the second valve 262. Then, the system 200 flows the working fluid 101 from the second valve 262 to the air heat reclaim unit 202, from the air heat reclaim unit 202 to the gas cooler 204, from the gas cooler 204 to the third valve 264, from the third valve 264 to the furth valve 266, and from the fourth valve 266 to the receiver tank 206.

In a gas cooler bypass mode, the system 200 flows the working fluid 101 from the first valve 260 to the second valve 262, from the second valve 262 to the third valve (through the gas cooler bypass line 246). Then, the system 200 flows the working fluid 101 from the third valve 264 to the fourth valve 266, and from the fourth valve 266 to the receiver tank 206. The gas cooler bypass mode can be combined with any of the other operation modes described herein.

In addition, the system 200 can operate in other modes such as only in water heating mode (in which working fluid 101 is not flowed to the air handler), only in subcooling or de-superheating air heating mode (in which the working fluid 101 is not flowed to the water heater), or any combination thereof.

With the heat reclaim system 200 arranged as a stage two system, the control system receives feedback from the air heat reclaim unit 202 and determines whether the system is to be set to subcooling mode or de-superheating mode. Then, the control system sets the heat reclaim system 200 in either subcooling mode or de-superheating mode.

Figure 3:
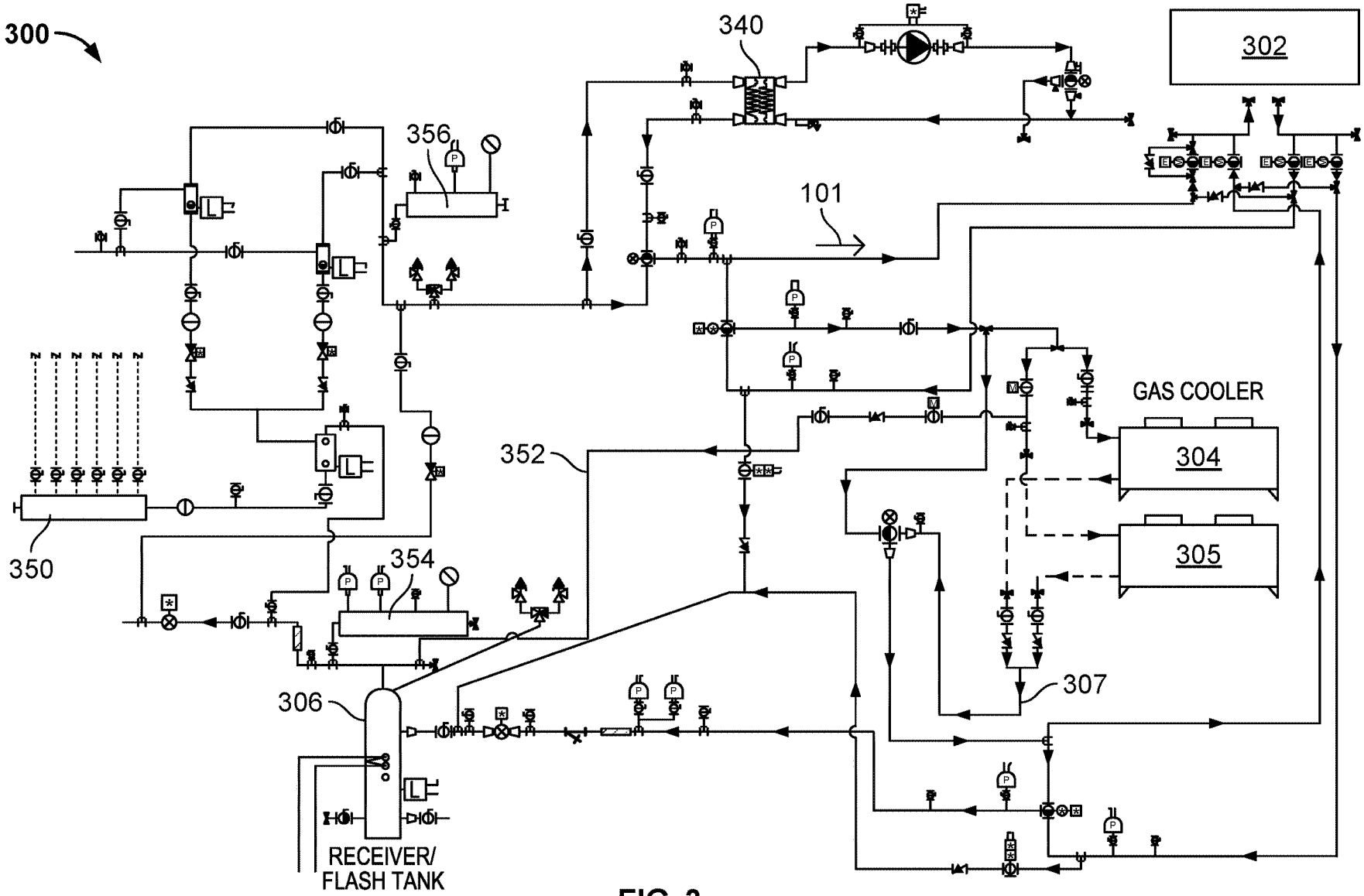
FIG. 3 is a schematic diagram of a heat reclaim system with multiple gas coolers.

FIG. 3 shows a schematic view of an example heat reclaim system 300 with a split gas cooler configuration. Specifically, the heat reclaim system 200 has two gas coolers 204, 205 with their outlets connected to a common line 307 that directs the working fluid 101 to the air heat reclaim unit 302 or the receiver tank 306. In some aspects, the heat reclaim system 300 can have more than two gas coolers 204 connected to the common line 307.

Figure 4:
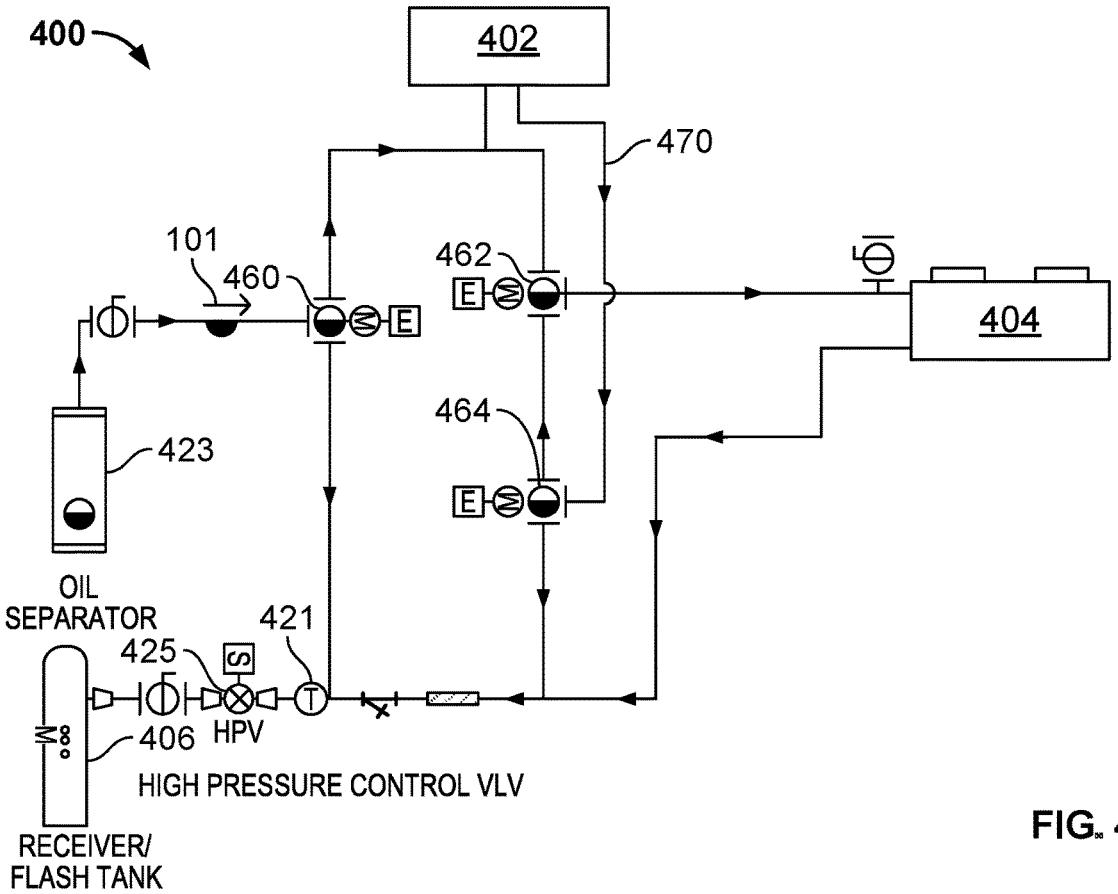
FIG. 4 is an example schematic diagram of a heat reclaim system according to another implementation of the present disclosure.

FIG. 4 shows a heat reclaim system 400 according to another example implementation of the present disclosure. The heat reclaim system 400 has one heat reclaim mode (e.g., de-superheating mode) and includes an air heat reclaim unit 402, a gas cooler 404, a receiver tank 406, an oil separator 423, a first 3-way valve 460, a second 3-way valve 462, and a third 3-way valve 464. In some aspects, the first and second 3-way valves 460, 464 are diverting valves and the second 3-way valve 462 is a mixing valve.

In a standard mode, the heat reclaim system 400 flows the working fluid 101 from the first valve 460 to the second valve 462, from the second valve 462 to the gas cooler 404, and from the gas cooler 404 to the receiver tank 406. If the temperature at the first temperature sensor 421 is less than a temperature threshold (for example, between 20 and 70 degrees Fahrenheit), the system 400 directs all or some of the working fluid 101 from the first valve 460 directly to the receiver tank 406, and some or none of the working fluid 101 to the second valve 462. If the system directs fluid to the second valve 462, the system 400 directs fluid from the second valve 462 to the gas cooler 404 and from the gas cooler 404 to the flash tank 406.

In a heat reclaim mode, the system 400 directs some or all of the working fluid 101 from the first valve 460 to the heat reclaim unit 402, and some or none to the gas cooler 404 through the second valve 462. Then, the system 400 directs the working fluid 101 from the heat reclaim unit 402 to the third valve 464 through a heat reclaim outlet line 470, and from the third valve 464 to the receiver tank 406.

In some aspects, the second valve is driven or controlled to provide less than 10-20 psig across the heat reclaim system 200. Moreover, the system 400 can also control the second valve 462 and a high pressure valve 425 disposed between the first valve 460 and the receiver tank 406 to provide variable refrigerant temperature and mass flow to the air heat reclaim unit 402.

Figure 5:
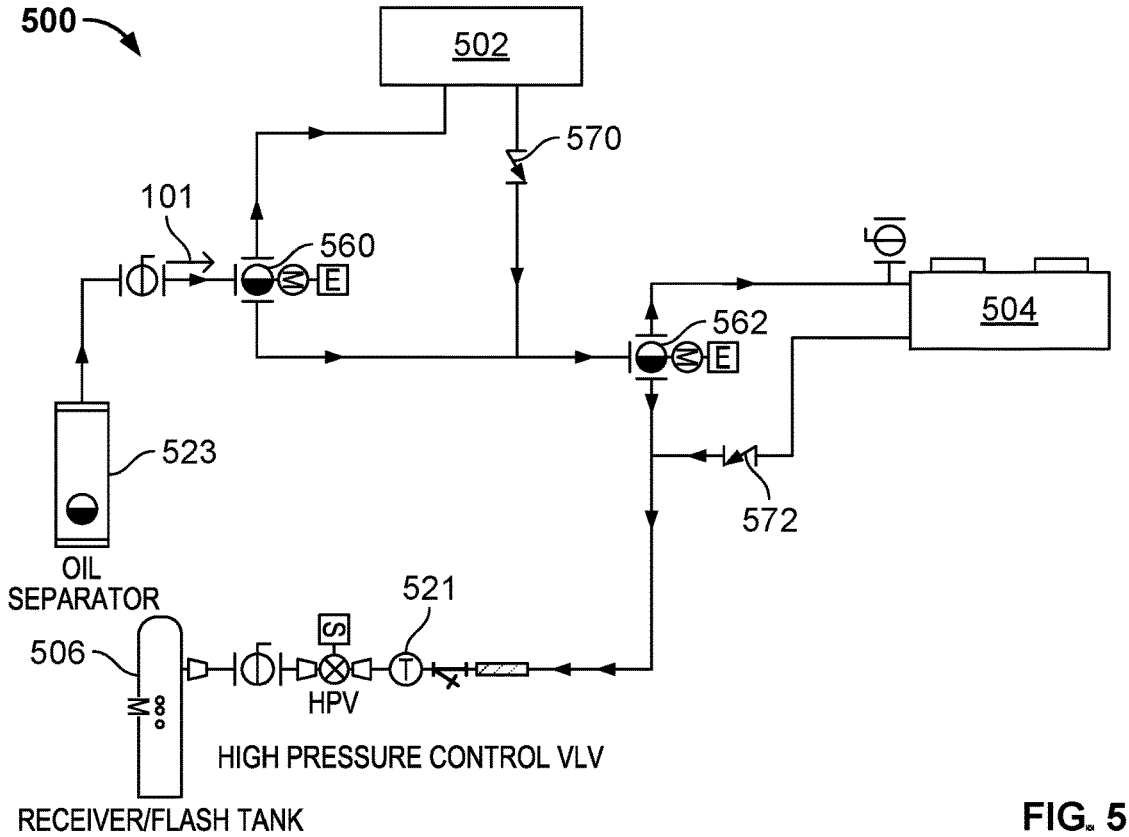
FIG. 5 is a schematic diagram of a heat reclaim system according to another implementation of the present disclosure.

FIG. 5 shows a heat reclaim system 500 according to another example implementation of the present disclosure. The heat reclaim system 500 has one heat reclaim mode (e.g., de-superheating mode). The heat reclaim system 500 includes a heat reclaim unit 502, a gas cooler 504, a receiver tank 506, an oil separator 523, a first 3-way valve 560, a second 3-way valve 562, a first check valve 570, and a second check valve 572.

In a standard mode, the system 500 flows the working fluid 101 from the first valve 560 to the second valve 562, from the second valve 562 to the gas cooler 504, and from the gas cooler 504 to the flash tank 506. In air heat recovery mode, the system 500 flows the working fluid 101 from the first valve 560 to the air heat reclaim unit 502, from the air heat reclaim unit 502 to the second valve 562, from the second valve 562 to the gas cooler 504, and from the gas cooler 504 to the receiver tank 506. In standard mode combined with gas cooler bypass mode, the system 500 flows the working fluid 101 from the first valve 560 to the second valve 562 and from the second valve 562 to the receiver tank 506. In air heat recovery mode combined with gas cooler bypass mode, the system 500 flows the working fluid 101 from the first valve 560 to the air heat recovery unit 502, from the air heat recovery unit 502 to the second valve 562, and from the second valve 562 to the receiver tank 506. The check valves 570, 572 prevent back flow of the working fluid 101 into the heat reclaim unit 502 or the gas cooler 504.

Figure 6:
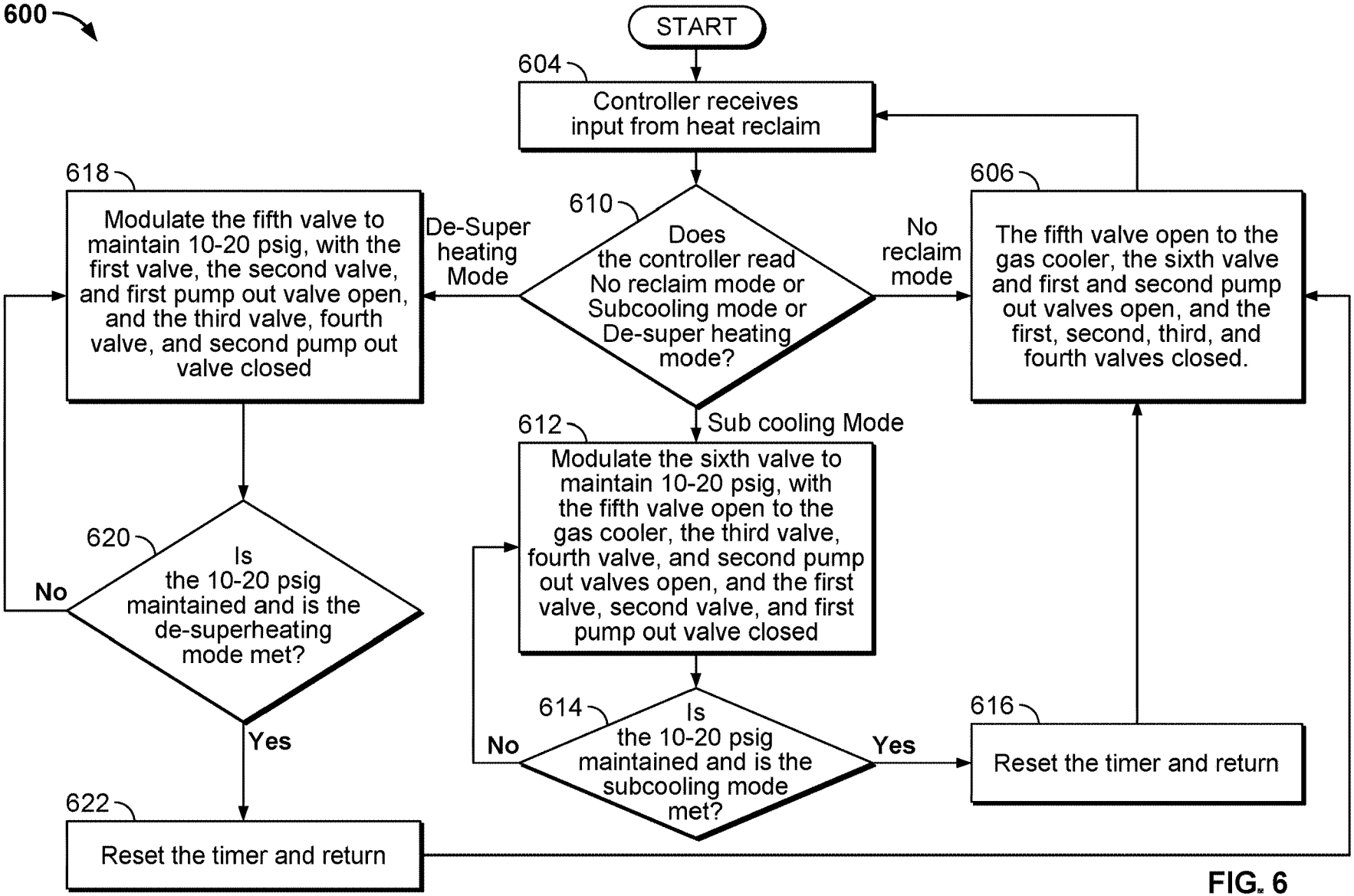
FIG. 6 is a block diagram of an example control logic according to implementations of the present disclosure.

FIG. 6 shows a decision flow diagram 600 of the refrigeration control system 105 (shown in FIG. 1). For example, the control system 105 can control the refrigeration system 100 based on inputs and decisions made with respect to those inputs. In the first step 604, the refrigeration control system 105 starts by receiving input from the heat reclaim sensors to control components of the refrigeration system based on the sensor input. In step two 610, the control system determines, as a function of the sensor input, the mode of operation in which the system is to be set. In the next step 606, if the mode of operation is a standard mode (e.g., no heat reclaim), the system opens and closes the valves necessary to set the system in standard mode. Alternatively, if the system determines that the mode of operation needed is subcooling mode, the next step 612 is to open and close the necessary valves to set the system in subcooling mode. Then, in the next step 614, the system determines whether the 10-20 psig is maintained and whether the subcooling mode is met. If yes, the system in the next step 616 resents the timer and returns to standard operation mode. If not, the system returns to step 612 to set or maintain the system is subcooling mode again.

Alternatively, if the system determines that the mode of operation needed is de-super heating mode, the next step 618 is to open and close the necessary valves to set the system in de-superheating mode. Then, in the next step 620, the system determines whether the 10-20 psig is maintained and whether the de-superheating mode is met. If yes, the system in the next step 622 resents the timer and returns to standard operation mode. If not, the system returns to step 618 to set or maintain the system is de-superheating mode.

Figure 7:
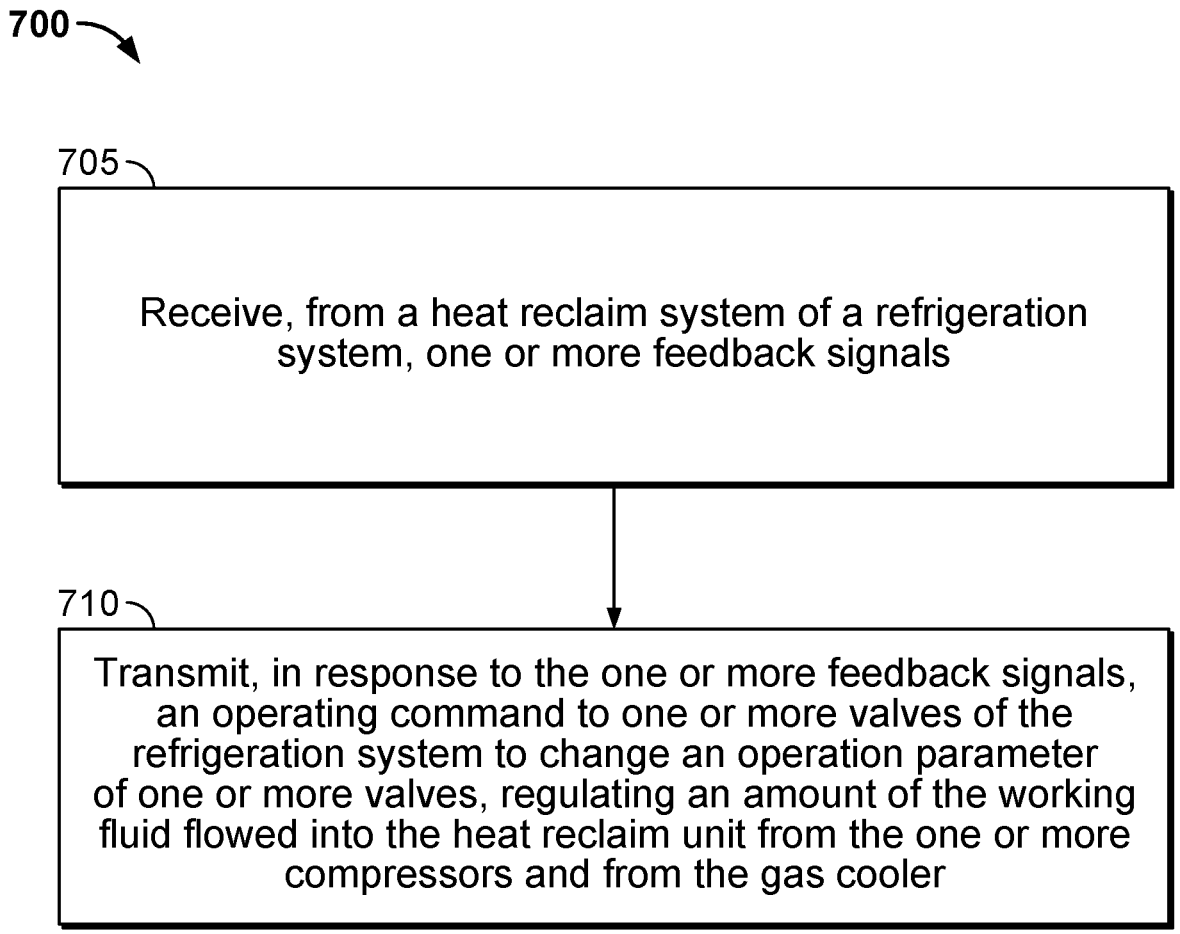
FIG. 7 is a flow chart of an example method of heat reclaim.

FIG. 7 shows a flow chart of an example method (700) of reclaiming heat from a refrigeration system. The method includes receiving, from a heat reclaim system of a refrigeration system (e.g., the refrigeration system 100 in FIG. 1), one or more feedback signals (705). The refrigeration system has one or more compressors, a gas cooler, and the heat reclaim unit fluidly coupled to and configured to receive working fluid from the one or more compressors and the gas cooler. The method also includes transmitting, in response to the one or more feedback signals, the operating command to one or more valves of the refrigeration system to change an operation parameter of one or more valves of the refrigeration system, regulating an amount of the working fluid flowed into the heat reclaim unit from the one or more compressors and from the gas cooler (710).

Figure 8:
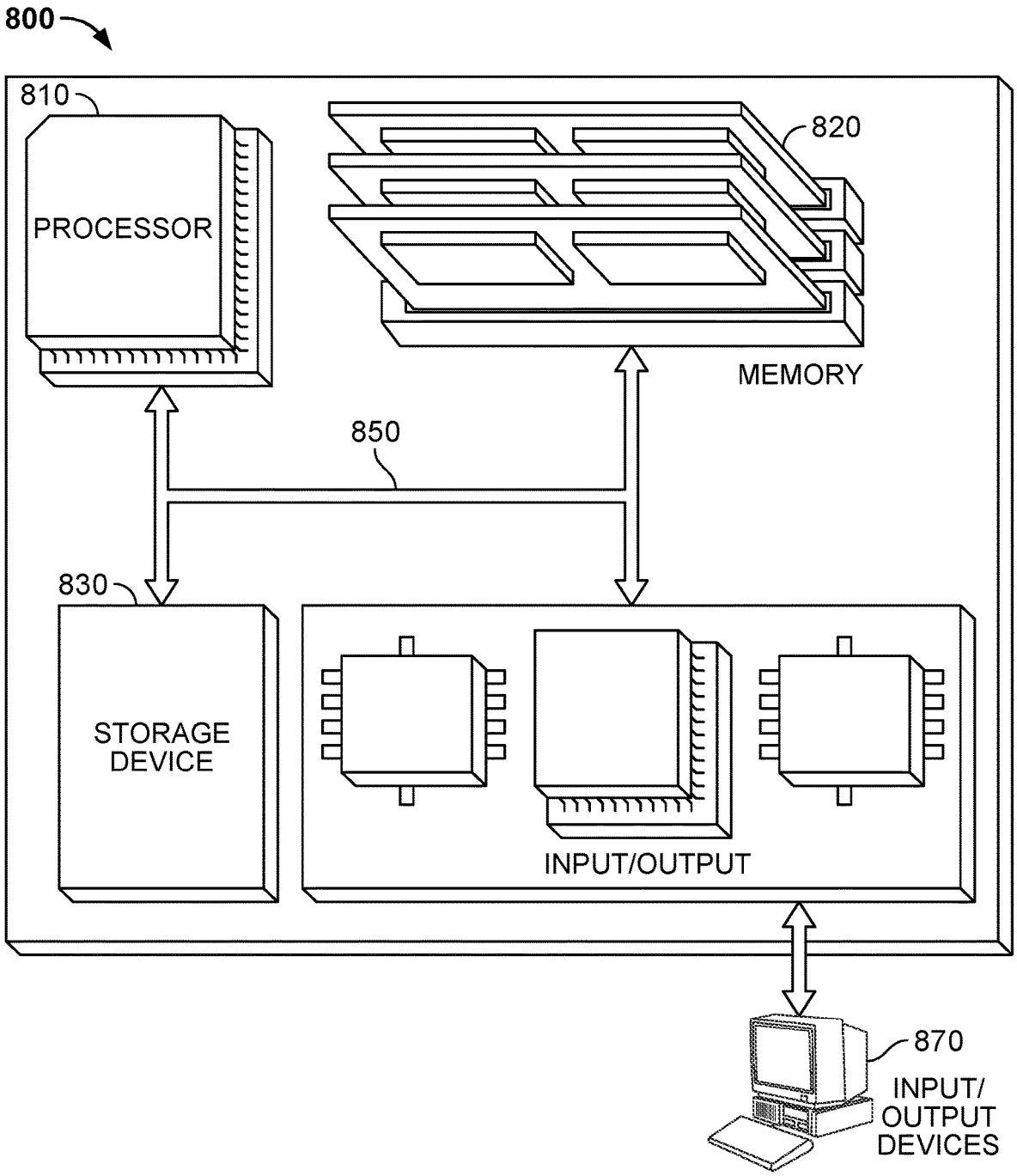
FIG. 8 is a schematic illustration of an example control system or controller for a refrigeration system.

FIG. 8 is a schematic illustration of an example control system or controller for a refrigeration system with heat reclaim according to the present disclosure. For example, the controller 800 may include or be part of the control system 105 in FIG. 1. The controller 700 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 800 includes a processor 810, a memory 820, a storage device 830, and an input/output device 840. Each of the components 810, 820, 830, and 840 are interconnected using a system bus 850. The processor 810 is capable of processing instructions for execution within the controller 800. The processor may be designed using any of a number of architectures. For example, the processor 810 may be a CISC (Complex Instruction Set Computers) processor, a RISC (Reduced Instruction Set Computer) processor, or a MISC (Minimal Instruction Set Computer) processor.

In one implementation, the processor 810 is a single-threaded processor. In another implementation, the processor 810 is a multi-threaded processor. The processor 810 is capable of processing instructions stored in the memory 820 or on the storage device 830 to display graphical information for a user interface on the input/output device 840.

The memory 820 stores information within the controller 800. In one implementation, the memory 820 is a computer-readable medium. In one implementation, the memory 820 is a volatile memory unit. In another implementation, the memory 820 is a non-volatile memory unit.

The storage device 830 is capable of providing mass storage for the controller 800. In one implementation, the storage device 830 is a computer-readable medium. In various different implementations, the storage device 830 may be a floppy disk device, a hard disk device, an optical disk device, or a tape device.

The input/output device 840 provides input/output operations for the controller 800. In one implementation, the input/output device 840 includes a keyboard and/or pointing device. In another implementation, the input/output device 840 includes a display unit for displaying graphical user interfaces.

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

What is claimed is:

1. A refrigeration system, comprising:

one or more compressors;

a gas cooler fluidly coupled, through a discharge line, to the one or more compressors;

a flash tank fluidly coupled, through a gas cooler line, to the gas cooler;

one or more evaporators fluidly coupled to the flash tank and the one or more compressors;

a heat reclaim system configured to receive a working fluid from the one or more compressors and the gas cooler, the heat reclaim system fluidly coupled, through a first supply line, to the one or more compressors, and fluidly coupled, through a second supply line, to the gas cooler;

a plurality of valves configured to regulate a flow of the working fluid from the one or more compressors and the gas cooler to the heat reclaim system, the plurality of valves comprising (i) a first valve attached to the first supply line fluidly connecting the discharge line to the heat reclaim system, (ii) a second valve attached to a first return line fluidly connecting the heat reclaim system to the discharge line, (iii) a third valve attached to the second supply line, and (iv) a fourth valve attached to a second return line fluidly connecting the heat reclaim system to the gas cooler line, and (v) a fifth valve comprising a 3-way mixing valve connected to and joining the gas cooler line to the second return line, the fifth valve configured to regulate a flow of working fluid from the heat reclaim system and the gas cooler to the flash tank;

a first pump out valve and a second pump out valve, the first pump out valve attached to a first pump out line fluidly connecting the second return line to the gas cooler line downstream of the fifth valve, and second pump out valve is attached to a second pump out line fluidly connecting the first return line to the first pump out line; and a control system configured to perform operations comprising:

receiving at least one feedback signal from the heat reclaim system; and in response to the at least one feedback signal, operating the plurality of valves to regulate an amount of the working fluid circulated into the heat reclaim system from the one or more compressors and the gas cooler.

2. The refrigeration system of claim 1, wherein the control system is configured to switch the plurality of valves between a standard mode, in which the first, second, third, and fourth valves are closed, a low heat load mode, in which the first and second valves are closed and the third and fourth valves are open, and a high heat load mode, in which the first and second valves are open and the third and fourth valves are closed.

3. The refrigeration system of claim 1, wherein the heat reclaim system comprises an air handling unit, the low heat load mode comprising a sub-cooling mode in which the working fluid heats air at a first temperature in the air handling unit, and the high heat load mode comprises a de-superheating heating mode in which the working fluid heats in the air at a second temperature in the air handling unit, the second temperature lower than the first temperature.

4. The refrigeration system of claim 1, wherein the heat reclaim system comprises a heat reclaim unit and a heat reclaim controller that transmits, as a function of a parameter of the heat reclaim unit, the at least one feedback signal to the control system.

5. The refrigeration system of claim 1, wherein the feedback signal is associated with a heat load required by the heat reclaim system.

6. The refrigeration system of claim 1, wherein the control system is configured to perform operations comprising:

receive sensor feedback from a temperature sensor coupled to the gas cooler line; and in response to the sensor feedback, operating the plurality of valves to maintain a temperature of the working fluid entering the flash tank above a temperature threshold.

7. The refrigeration system of claim 2, wherein the refrigeration system comprises a sixth valve comprising a 3-way mixing valve connected to and joining the discharge line to the first return line, the sixth valve configured to regulate a flow of working fluid from the one or more compressors and the heat reclaim system into the gas cooler.

8. The refrigeration system of claim 7, wherein the control system is configured to set the sixth valve in one of (i) the standard mode, in which a first inlet of the sixth valve connected to the first return line is closed and a second inlet of the sixth valve connected to the discharge line is open, (ii) the low heat load mode, in which the sixth valve is in the same position as in the standard mode, or (iii) the high heat load mode, in which the sixth valve maintains a predetermined pressure differential across the sixth valve.

9. The refrigeration system of claim 2, wherein the control system is configured to set the fifth valve in one of (i) the standard mode, in which the fifth valve is open, (ii) the low heat load mode, in which the fifth valve maintains a predetermined pressure differential across the fifth valve, (iii) and the high heat load mode, in which the fifth valve is open.

10. The refrigeration system of claim 2, wherein the control system is configured to perform operations comprising one of (i) opening, during the standard mode, the first and second pump out valves, (ii) during the low heat load mode, closing the first pump out valve and open the second pump out valve, or (iii) during the high heat load mode, opening the first pump out valve and closing the second pump out valve.

11. The refrigeration system of claim 1, wherein the working fluid comprises carbon dioxide refrigerant.

12. The refrigeration system of claim 4, wherein the heat reclaim system comprises a water heater and the parameter comprises a temperature of supply water within the water heater.

13. The refrigeration system of claim 1, wherein the heat reclaim system is a first heat reclaim system and the refrigeration system comprises a second heat reclaim system fluidly coupled, through a set of supply and return lines, to the discharge line of the one or more compressors, the first heat reclaim system comprising an air handler and the second heat reclaim system comprising a water heater.

14. The refrigeration system of claim 13, wherein the control system is configured to control, as a function of the at least one feedback signal, the plurality of valves, regulating an amount of the working fluid flowed into the water heater from the one or more compressors.

15. The refrigeration system of claim 6, wherein the working fluid comprises carbon dioxide refrigerant.

16. The refrigeration system of claim 15, wherein the heat reclaim system comprises a water heater and the parameter comprises a temperature of supply water within the water heater.

17. The refrigeration system of claim 15, wherein the heat reclaim system is a first heat reclaim system and the refrigeration system comprises a second heat reclaim system fluidly coupled, through a set of supply and return lines, to the discharge line of the one or more compressors, the first heat reclaim system comprising an air handler and the second heat reclaim system comprising a water heater.

18. The refrigeration system of claim 15, wherein the control system is configured to set the fifth valve in one of (i) a standard mode, in which the fifth valve is open, (ii) a low heat load mode, in which the fifth valve maintains a predetermined pressure differential across the fifth valve, (iii) and a high heat load mode, in which the fifth valve is open.

19. The refrigeration system of claim 15, wherein the control system is configured to perform operations comprising one of (i) opening, during a standard mode, the first and second pump out valves, (ii) during a low heat load mode, closing the first pump out valve and open the second pump out valve, or (iii) during a high heat load mode, opening the first pump out valve and closing the second pump out valve.

20. The refrigeration system of claim 15, wherein the refrigeration system comprises a sixth valve comprising a 3-way mixing valve connected to and joining the discharge line to the first return line, the sixth valve configured to regulate a flow of working fluid from the one or more compressors and the heat reclaim system into the gas cooler, and the control system is configured to set the sixth valve in one of (i) a standard mode, in which a first inlet of the sixth valve connected to the first return line is closed and a second inlet of the sixth valve connected to the discharge line is open, (ii) a low heat load mode, in which the sixth valve is in the same position as in the standard mode, or (iii) a high heat load mode, in which the sixth valve maintains a predetermined pressure differential across the sixth valve.

* * * * *